United States Patent [19]

O'Keefe et al.

[11] Patent Number: 4,601,143

[45] Date of Patent: Jul. 22, 1986

[54] FIRE RATED WALL/DOOR SYSTEM

[75] Inventors: William F. O'Keefe; Sonny Q. Garcia, both of San Francisco, Calif.

[73] Assignee: O'Keefe's, Inc., San Francisco, Calif.

[21] Appl. No.: 574,010

[22] Filed: Jan. 26, 1984

[51] Int. Cl.[4] ..... E04C 1/94

[52] U.S. Cl. ..... 52/171; 52/204; 52/573

[58] Field of Search ..... 52/204, 171, 790, 232, 52/573, 475

[56] References Cited

U.S. PATENT DOCUMENTS

| | | | |
|---|---|---|---|
| 2,443,548 | 6/1948 | Wilson | 52/241 |
| 3,300,919 | 1/1967 | Hiller | 52/241 |
| 3,453,790 | 7/1969 | Harris | 52/241 |
| 4,164,107 | 8/1979 | Kraemling | 52/232 |
| 4,164,108 | 8/1979 | Ortmanns | 52/232 |
| 4,173,668 | 11/1979 | Hentzelt | 52/171 |
| 4,424,653 | 1/1984 | Heinen | 52/232 |

FOREIGN PATENT DOCUMENTS

| | | | |
|---|---|---|---|
| 3027439 | 2/1982 | Fed. Rep. of Germany | 52/232 |
| 2067639 | 7/1981 | United Kingdom | 52/232 |

*Primary Examiner*—John E. Murtagh

*Attorney, Agent, or Firm*—Flieser, Dubb, Meyer & Lovejoy

[57] ABSTRACT

A fire rated wall/door system 10 comprises a transparent panel 12 which is supported by a frame means 23 for protecting the peripheral edge 40 of the panel 12 from delamination. Further, mounting means 32 mount the frame 23 in a wall 30 so as to accommodate expansion of the panel 12 and frame 23 to prevent panel bowing with resultant delamination of panel 12 and premature failure.

6 Claims, 6 Drawing Figures

FIRE RATED WALL/DOOR SYSTEM

FIELD OF THE INVENTION

The present invention relates to a fire rated wall-/door system and in particular to one with a transparent panel.

BACKGROUND OF THE INVENTION

There is often a requirement that a fire rated wall-/door systems include a transparent window for aesthetic and security reasons. For example, it is desirable to have important documents retained in vaults which are enclosed by a fire rated wall/door system and to provide for windows in the walls so that the vaults can be easily observed. Also it is desirable to have such secure areas feel as open as possible so that people working therein will have a pleasant environment. Heretofore, fire rated wall/door systems have been limited to having windows in doors which are limited in total area to less than 100 square inches so that the windows can withstand a specified temperature for a specified length of time to receive a required rating. The glass has been limited to glass which is reinforced with a wire mesh. Certainly it would be more desirable to have a larger window that looked like a standard window or door for all of the above indicated reasons and still have the system be able to obtain the required fire rating.

It is to be understood that the need for fire rated wall systems extends from internal wall systems with and without doors to external storefront wall systems with and without doors.

A new transparent glass assembly has recently become available. This system is comprised of first and second panes of toughened or tempered safety glass for 60-minute rating and a third pane for 90-minute rating which are held apart by a metal spacer running about the periphery thereof. The cavity formed between the two panes of glass are then filled with a transparent gel capable of absorbing heat radiation. Heat absorption leads to modification of organic compounds in the gel, forming a dense and highly heat insulating crust after the first pane adjacent the heat is shattered by the heat. This crust slowly propagates itself from the shattered first pane toward the second pane which is not exposed to the heat. During this process the gel does not separate from the second pane. It should be understood that this material not only stops smoke and flames as with prior window material comprised of wired glass or glass brick, but also prevents heat radiation from passing therethrough. Such heat radiation can inflame curtains, furniture, and other flammable materials, even though the flames are contained behind the fire rated wall.

This glass assembly gives rise to the possibility of much larger transparent windows or openings in a fire rated wall/door system. However, the size of such panels gives rise to thermal expansion problems which were not considered previously. Also it should be understood that the periphery of this transparent panel needs to be protected. In the past, such protection has been afforded through the use of wallboard and some fire-resistant materials.

The present invention is provided to overcome one or more of the disadvantages of the prior devices.

SUMMARY OF THE INVENTION

The present invention includes a fire rated wall/door system comprising a fire rated transparent glass assembly having outer layers of transparent tempered glass panes enclosing an inner layer of a transparent heat absorbing gel medium, said panel having a peripheral edge. The wall system further includes frame means for supporting the panel and protecting the peripheral edge from a fire. Further, the system includes means for mounting the frame means into a fire rated wall so as to accommodate expansion of the panel and frame to prevent panel and frame bowing and panel delamination.

In another aspect of the invention, the mounting means includes a rod extending from one of the frame means and the wall and a cylinder means for receiving and guiding the rod extending from the other of said frame means and said wall, with the rod being urged further into said cylinder as said panel and frame expand due to heat.

In yet another aspect of the invention, the mounting means includes compressable fire rated material covering said rod and said cylinder means and extending between said frame means and the fire rated wall.

In still another aspect of the invention, the frame means includes fire rated material covering said peripheral edge of the panel and a steel plate covering the fire rated material.

From the above, it can be seen that the present invention provides for a fire rated wall/door system that mounts and protects a transparent panel so that the panel can provide maximum effective protection from smoke, flame and heat radiation.

DETAILED DESCRIPTION OF THE PREFERRED EMBODIMENT

Figure 1:
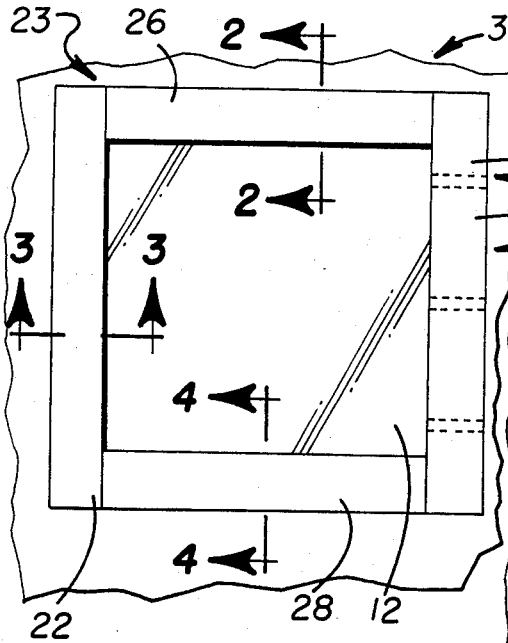
FIG. 1 depicts a front view of a fire rated wall/door system of the invention.
Figure 2:
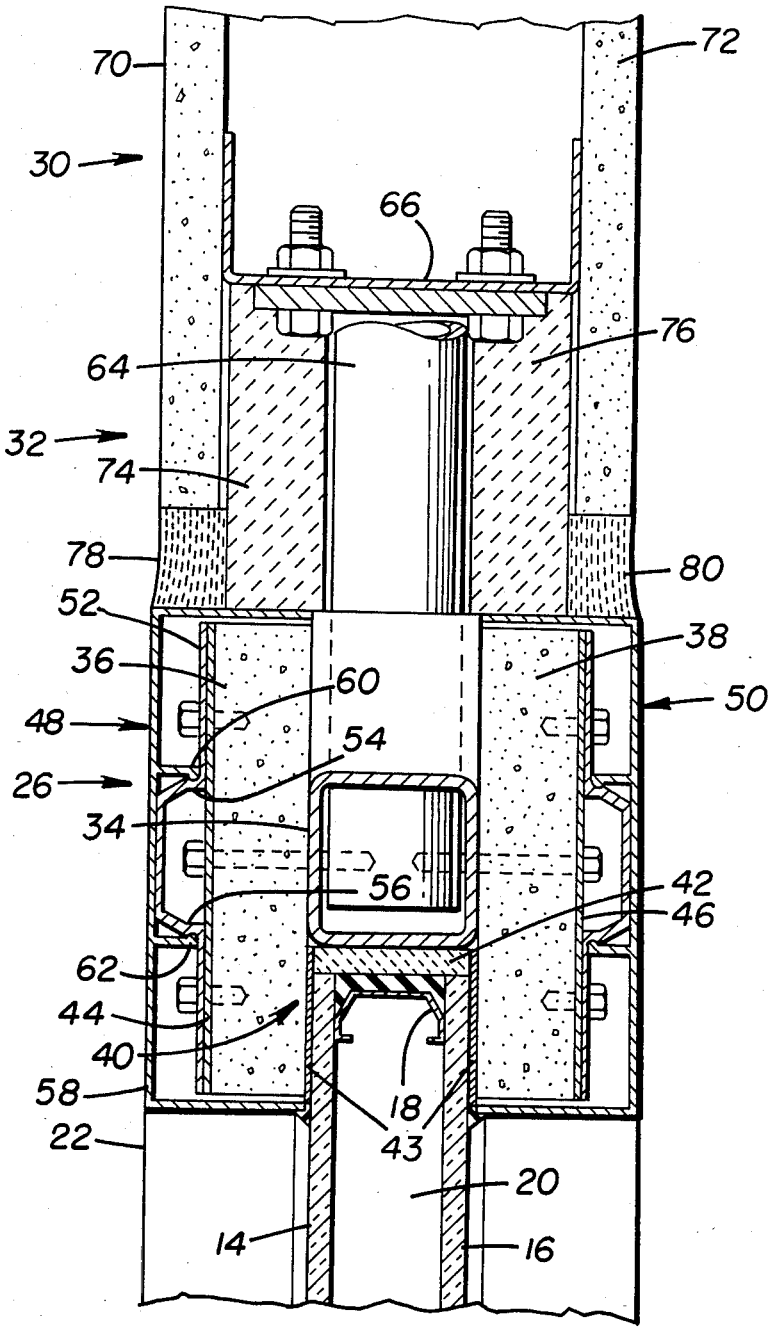
FIG. 2 depicts a cross-sectional view taken through line II—II in FIG. 1.

With reference to the figures, and in particular to FIG. 1, the fire rated wall/door system 10 of the invention is depicted. The fire rated wall/door system 10 includes a transparent panel 12 which can be the size of, for example, a standard and larger storefront window and which, in fact, as disclosed hereinbelow, can comprise a door in the fire rate wall/door system 10. Transparent panel 12 in a preferred embodiment is comprised of a commercially available panel. This panel is comprised of first and second outer layers of tempered glass pane 14 and 16 which are held apart by spacer 18 and which enclose a transparent gel 20 capable of absorbing heat radiation (FIG. 2). The panel is held in a frame 23 which is comprised of vertical jamb members 22 and 24, horizontal head member 26 and horizontal sill member 28. These members 22, 24, 26 and 28 are in turn set into a wall 30. As will be described more fully hereinbelow, means 32 is provided for mounting the frame in the wall so as to accommodate expansion of the panel and the frame to prevent panel and frame bowing and panel delamination.

Viewing FIG. 2, the horizontal head member 26 is comprised of a tubular member 34 which in a preferred embodiment is comprised of steel. Secured to the tubular member are first and second shields 36 and 38 which are bolted to the tubular member 34. These shields in a preferred embodiment are comprised of calcium silicate boards. These shields protect the peripheral edge 40 of the panel from fire and heat so that premature delamination does not occur between the panes 14 and 16 and the gel 20. Also protecting the peripheral edge 40 of the panel 12 is a layer of refractory fiber blanket 42 and refractory tape 43. On the outer surfaces of the first and second shields 36 and 38, metal plates 44 and 46 are positioned. These metal plates 44 and 46 in a preferred embodiment are comprised of steel and offer some measure of fire protection for the first and second shields 36 and 38. These steel pieces are spliced with one-half inch spaces in between pieces for expansion. Also secured to the first and second shield 36 and 38 as shown in FIG. 2 are first and second cladding arrangement 48, 50. These cladding arrangements are comprised of aluminum in a preferred embodiment. Each cladding arrangement includes a first member such as member 52 which is secured to the plate 44 and the first shield 36 by the bolt shown, and which includes recesses 54 and 56. The cladding arrangement 48 further includes a second member 58 which encases the first member 52 and the first shield 36 and has protrusions 60 and 62 which snap into recesses 54 and 56 to retain the second member of the cladding arrangement in position. This system eliminates the use of exposed fasteners.

Figure 3:
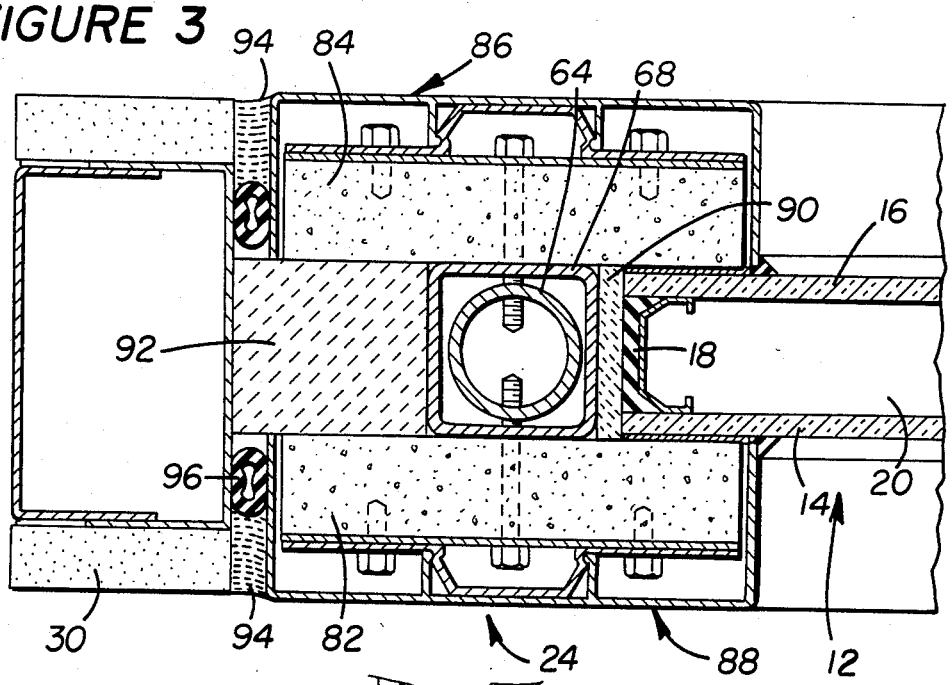
FIG. 3 depicts a cross-sectional view taken through line III—III in FIG. 1.

The means 32 for mounting the frame 23 into the wall 30 includes a rod or shaft 64 which is mounted by mount 66 into wall 30 and which projects downwardly into the vertical tubular member 68 (FIG. 3).

The wall 30 is comprised of first and second outer layers 70 and 72, which in a preferred embodiment can be gypsum board. Immediately surrounding the rod or shaft 64 are flexible and collapsible refractory materials 74 and 76, which in a preferred embodiment are comprised of a refractory fiber blanket. The space between the outer layers 70 and 72 and the cladding arrangement 48 and 50 is filled with a flexible fire retardant caulking material 78, 80.

In FIG. 3, the vertical jamb member 24 is depicted in cross section and is configured similarly as horizontal head member 26 in that it includes shields 82 and 84, which are similar to first and second shields 36 and 38, and cladding arrangements 86 and 88, which are similar to first and second cladding arrangements 48 and 50. A refractory fiber blanket 90, in a preferred embodiment, is disposed between panel 12 and tubular member 68. Additionally fire resistant material 92 is provided between the tubular member 68 and the wall 30. Finally, fire resistant caulking 94 and fire resistant gaskets 96 add a measure of flexibility between the wall and the vertical jamb member 24.

Figure 4:
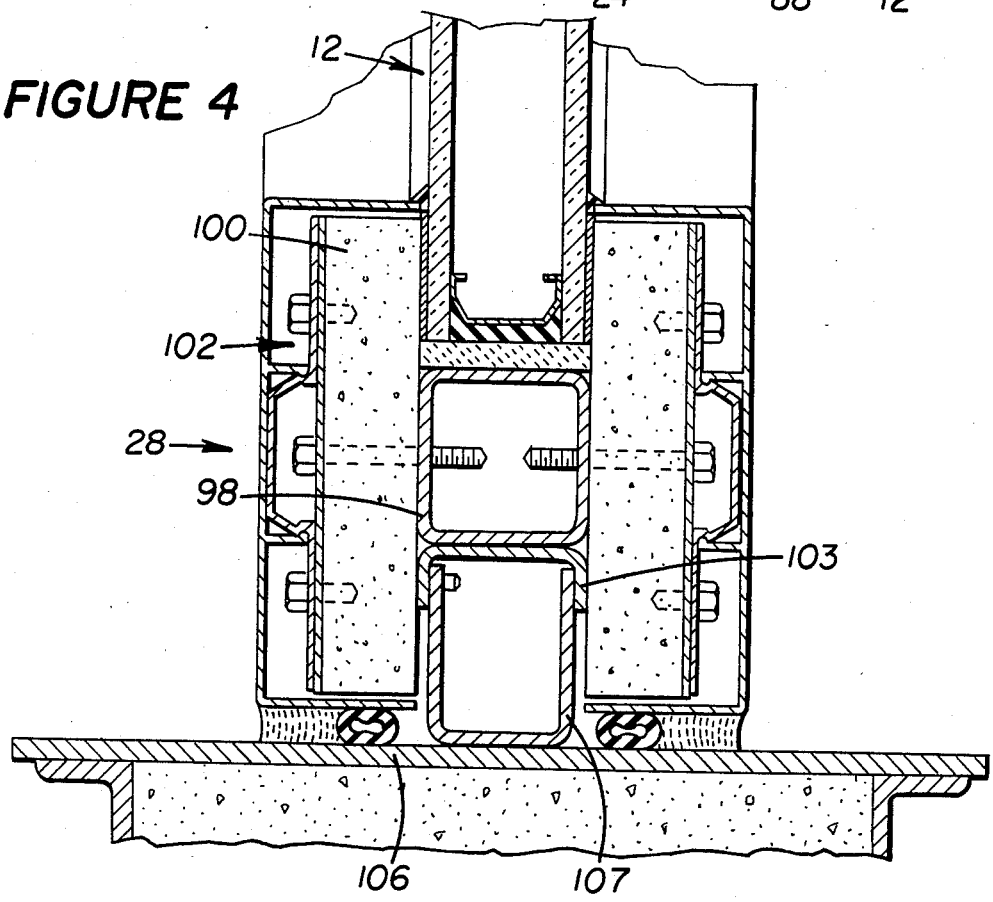
FIG. 4 depicts a cross-sectional view taken through line IV—IV in FIG. 1.

Turning to FIG. 4, a cross section of the horizontal sill member 28 is depicted. This sill member 28 is similar in configuration to the vertical jamb member 24 of FIG. 3 in that it includes a tubular member 98 which abuts against the panel 12, both of which are protected by shields such as shield 100 and cladding arrangements such as cladding arrangement 102. The tubular member 98, in a preferred embodiment, has welded thereto a U-shaped member 102 which receives a second U-shaped member 107, which in a preferred embodiment is welded to a sill plate 106. The U-shaped member 107 assists in positioning the remainder of the horizontal sill member 28.

If a fire should occur, the panel and frame will tend to expand, and this expansion can be taken up by the upward movement of the frame 23 and panel 12, with the tubular member 68 of the vertical jamb members being urged over and guided by the downwardly directed rod 64. The material such as caulking 78 and 80 and refractory material 74 and 76, being flexible, tends to give way as this expansion occurs. This expansion prevents the bowing of the panel with the resultant undesirable delamination of the gel from the glass, causing premature failure of the panel. Additionally the shields, such as shield 36, 38, protect the peripheral edge 40 of the panel so that the delamination can not start at the peripheral edge 40.

It is to be understood that if required, mounting means such as mounting means 32 can be provided adjacent the vertical jamb members 22 and 24 and the horizontal sill member 28 to add extra expansion capabilities.

Also it is to be understood that each metal plates, such as plate 46 (FIG. 1, 2), can be segmented into several parts such as parts 160, 162. Such an arrangement offers additional expansion capabilities.

INDUSTRIAL APPLICABILITY

Figure 5:
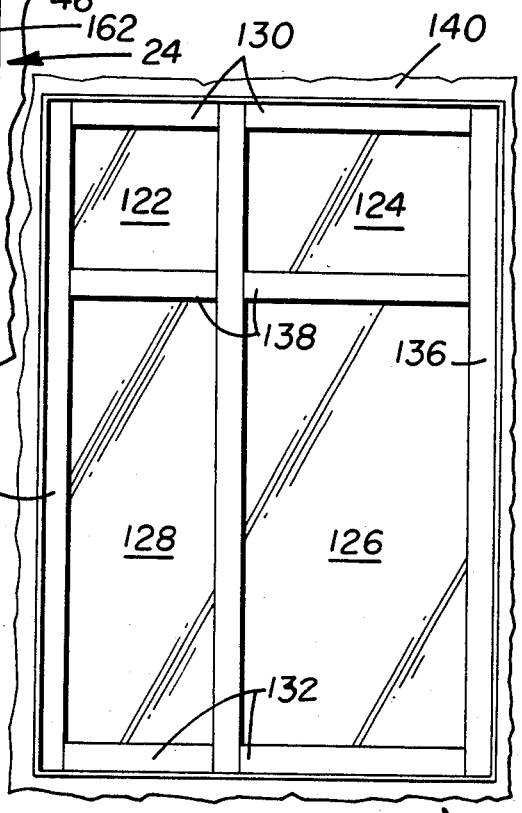
FIG. 5 depicts an alternate embodiment of the fire rated wall/door system of the invention.
Figure 6:
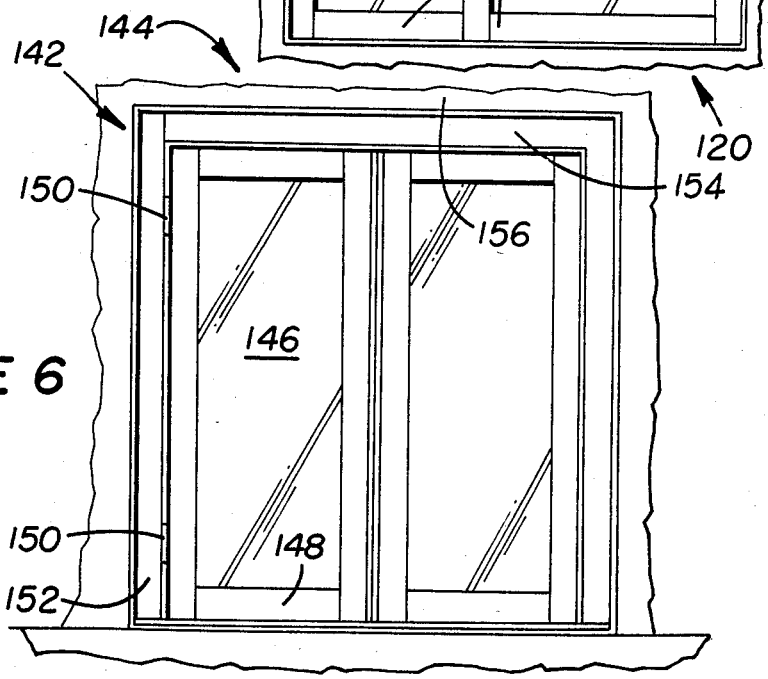
FIG. 6 depicts yet another embodiment of the fire rated wall/door system of the invention including doors.

In practice, fire rated wall systems 10 such as described hereinabove with a single panel can be rated to withstand about 1700° F. for one hour. With a double panel (i.e., three glass panes with gel provided between each pair of panes), the system can withstand this temperature for ninety minutes. It is to be understood that other wall systems, such as wall system 120 (FIG. 5), can be constructed from the teachings of the above embodiment. In wall system 120, four panels 122, 124, 126 and 128 are held in position by head members 130, sill members 132, jamb members 134 and 136 and horizontal mullions 138. It is to be understood that mounting means, such as mounting means 32 in FIG. 1, can be associated between the head member 130 and the wall 140.

Further it is to be understood that a door arrangement such as door arrangement 142 can be provided in a wall system such as wall system 144. Door arrangement 142 includes a panel 146 which is similar to panel 12, held in a frame 148 which is similar to frame 23. The frame 148 is pivotally hinged at hinges 150 so that it can swing relative to outer frame 152. Outer frame 152 is also constructed similarly to frame 23, and it is to be understood that mounting means such as mounting means 32 in FIG. 1 are disposed between the head member 154 of the outer frame 152 and the wall 156. From the above, it can be seen that the present invention provides for a fire rated wall/door system that protects the transparent panel from delamination by protecting the peripheral edge thereof and also by accommodating the expansion of the panel and the frame disposed thereabout so as to prevent panel bowing.

Other aspects, objects and advantages of the invention can be ascertained from a review of the claims and the appended figures.

We claim:

1. A fire rated structure system comprising:

a fire rated transparent glass assembly having outer layers of transparent tempered glass enclosing an inner layer of transparent heat-absorbing gel medium, said assembly having a peripheral edge;

frame means for supporting the assembly and protecting the peripheral edge from a fire so as to prevent delamination of the glass from the gel medium;

a fire rated wall;

means for mounting the frame means into said fire rated wall so as to accommodate expansion of the assembly and frame to prevent assembly and frame bowing and assembly delamination;

said mounting means including:

(a) a rod extending from one of said frame means and said wall;

(b) a cylinder means for receiving and guiding said rod, said cylinder means extending from the other of said frame means and said wall from which said rod extends, with said rod being urged further into said cylinder means as said assembly and frame expand; and (c) flexible fire rated material covering said rod and said cylinder means and extending between said frame means and said fire rated wall.

2. The system of claim 1 wherein said frame means includes upper, lower, and side portions, and wherein one of said upper and lower portions are mounted rigidly to said wall, and the other of said upper and lower portions being interconnected with the wall by the rod and the cylinder means.

3. The system of claim 1 including a plurlaity of rods extending from one of said frame means and said wall, and said cylinder means for receiving and guiding said rods, and extending from the other of said frame means and said wall.

4. The system of claim 1 wherein said frame means includes:

fire rated material covering said peripheral edge; and a steel plate covering said fire rated material.

5. The system of claim 1 wherein said frame means includes:

a first frame secured to said assembly;

a second frame secured to said wall;

means for securing said first frame to said second frame so that said first frame can swing open relative to said second frame.

6. The system of claim 1 wherein said frame means includes sides extending for a full length of the assembly which have segmented portions, and means for allowing the segmented portions to expand relative to each other.

* * * * *

UNITED STATES PATENT AND TRADEMARK OFFICE

CERTIFICATE OF CORRECTION

PATENT NO. : 4,601,143
APPLICATION NO. : 06/574010
DATED : July 22, 1986
INVENTOR(S) : O'Keeffe et al.

It is certified that error appears in the above-identified patent and that said Letters Patent is hereby corrected as shown below:

On the front page, at item [75]. please replace "William F. O'Keefe" with --William F. O'Keeffe--.

On the front page, at item [73], please replace "O'Keefe's, Inc." with --O'Keeffe's, Inc.--.

Signed and Sealed this

Twenty-first Day of August, 2007

JON W. DUDAS
*Director of the United States Patent and Trademark Office*